United States Patent [19]

Asaka et al.

[11] Patent Number: 4,551,074

[45] Date of Patent: Nov. 5, 1985

[54] AIR PUMP APPARATUS

[75] Inventors: Urataro Asaka, Kamifukuoka; Shigeo Kanai, Miyazaki; Yasuhiro Tanaka, Miyazaki; Kazuya Iwamoto, Miyazaki, all of Japan

[73] Assignees: Honda Giken Kogyo Kabushiki Kaisha, Tokyo; Kabushiki Kaisha Honda Rokku, Kiyazaki, both of Japan

[21] Appl. No.: 428,795

[22] Filed: Sep. 30, 1982

[30] Foreign Application Priority Data

| | | | |
|---|---|---|---|
| Oct. 1, 1981 | [JP] | Japan | 56-154745 |
| Oct. 1, 1981 | [JP] | Japan | 56-154746 |
| Oct. 1, 1981 | [JP] | Japan | 56-144981 |
| Oct. 1, 1981 | [JP] | Japan | 56-144982[U] |

[51] Int. Cl.[4] ..... F04B 35/04; F01B 31/10

[52] U.S. Cl. ..... 417/366; 417/415; 417/440; 92/158

[58] Field of Search ..... 417/415, 371, 369, 366, 417/440, 296, 307; 92/158, 159, 160

[56] References Cited

U.S. PATENT DOCUMENTS

| | | | |
|---|---|---|---|
| 1,187,031 | 6/1916 | Black | 417/415 |
| 1,508,805 | 9/1924 | Shaw | 417/371 |
| 2,123,815 | 7/1938 | Tweddell | 417/440 X |
| 4,304,410 | 12/1981 | Erickson et al. | 92/158 |

*Primary Examiner*—Cornelius J. Husar
*Assistant Examiner*—Peter M. Cuomo
*Attorney, Agent, or Firm*—Armstrong, Nikaido, Marmelstein & Kubovcik

[57] ABSTRACT

An air pump apparatus having a cylinder extending from a pump casing. The cylinder comprises a cylinder liner positioned within the walls of the cylinder and a piston is mounted for reciprocating movement within the cylinder liner. The pump chamber is formed between the front of the piston and the front portion of the cylinder wherein an annular gap is formed between the piston and the inner wall of the cylinder liner, wherein the piston has a plurality of annular grooves formed on the outer circumferential surface thereof, the annular gap and annular grooves forming a labyrinth path extending from the pump chamber.

6 Claims, 4 Drawing Figures

AIR PUMP APPARATUS

BACKGROUND OF THE INVENTION

1. Field of the Invention

This invention relates to an air pump apparatus for use primarily in a motorized two-wheeled vehicle.

2. Description of the Prior Art

One type of prior art air pump apparatus comprises a cylinder, extending forwards from a pump casing such as a crankcase or the like, having therein a cylinder liner and a piston mounted in the cylinder liner and arranged to be driven to reciprocate forwards and rearwards by a driving source such as an electric motor or the like. An air space is formed in front of the piston to serve as a pump chamber. It has been usual with this type of air pump that a lubrication oil such as grease or the like is applied to the piston at a portion thereof between the piston and the cylinder liner. However, this causes an undesirable result in which the compressed air produced contains the oil.

SUMMARY OF THE INVENTION

It is an object of the present invention to provide an air pump apparatus which eliminates oil and grease from the pumped air.

It is a further object of the present invention to provide an air pump in which cooling air from the pump chamber is used to cool the motor which drives the pump piston.

It is still another object of the present invention to provide an air pump with a permeable cylinder lining to increase the cooling of the pump cylinder.

It is still a further object of the present invention to provide an air pump which has an axial aligned outlet valve and safety valve thereby reducing the space required for such valves.

The present invention is directed to an air pump apparatus having a cylinder extending from a pump casing. The cylinder comprises a cylinder liner positioned within the cylinder wall and a piston mounted for reciprocating movement within the cylinder liner. A pump chamber is formed between the front of the piston and front portion of the cylinder. An annular gap is formed between the piston and the inner wall of the cylinder liner and the piston has a plurality of annular grooves formed on the outer peripheral surface thereof, wherein the annular gap and annular grooves form a labyrinth path extending from the pump chamber. The outlet valve and safety valve of the cylinder are axially aligned to save space and the cylinder liner may be made of a permeable sintered alloy to enhance cooling of the cylinder.

DETAILED DESCRIPTION OF THE PREFERRED EMBODIMENT

Figure 1:
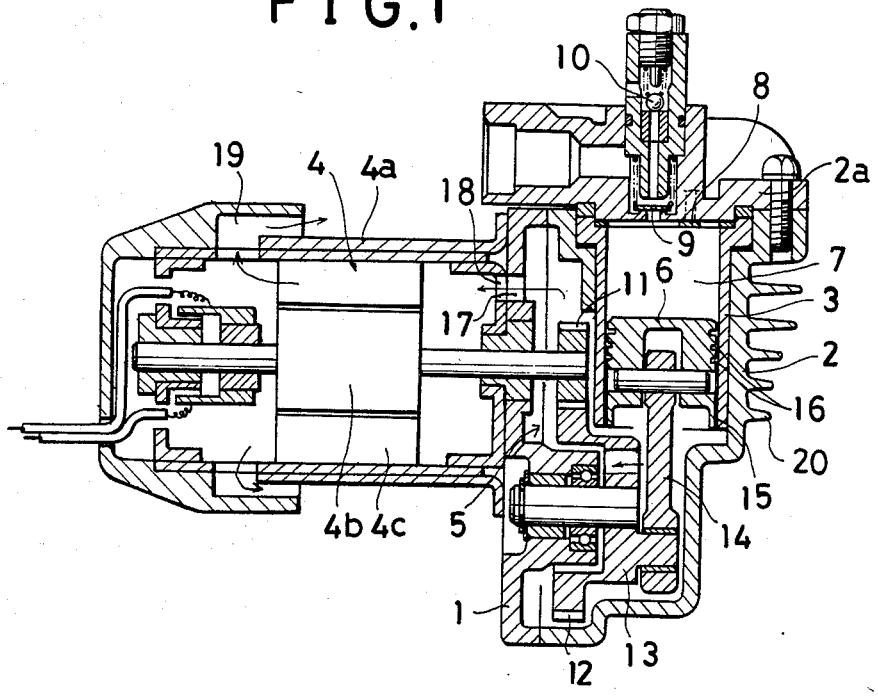
FIG. 1 is a sectional side view of a preferred embodiment of the present invention.
Figure 2:
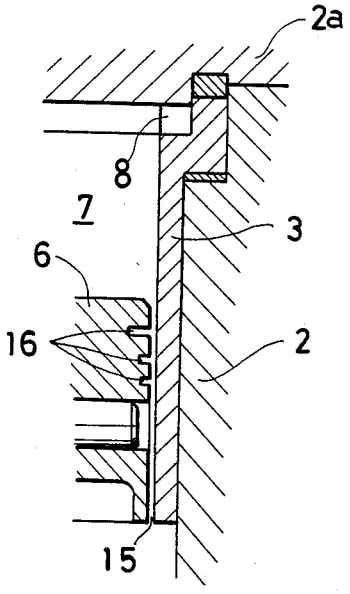
FIG. 2 is an enlarged sectional view of an important portion thereof.

Referring to FIGS. 1 and 2, a pump casing 1 such as a crankcase or the like, includes a cylinder 2 extending forwardly from the casing 1. The cylinder 2 is provided therein with a cylinder liner 3 located along the inner circular side surface thereof, and is additionally provided with a piston 6 mounted in the cylinder liner 3 and arranged to be driven to reciprocate forwards and rearwards by means of a power transmission mechanism 5 provided in the pump casing 1. The transmission mechanism 5 is connected to an electric motor 4 serving as a driving source. An air space in front of the piston 6 in the cylinder 1 serves as a pump chamber 7. Additionally, the cylinder 2 is provided at its front portion with a reed valve type inlet valve 8, an outlet valve 9 and safety valve 10.

The electric motor 4 is horizontally positioned on the side wall of the pump casing 1. The power transmission mechanism 5 comprises a gear 12 meshed with a gear 11 on an output shaft of the motor 4 which is connected through a crank 13 on the side surface of the gear 12 to a connecting rod 14 extending rearward from the piston 6 such that the piston 6 is reciprocated forward and rearward by the electric motor 4.

The above construction is not especially different from that in a conventional apparatus. However, according to the present invention, as shown clearly in FIG. 2, the piston 6 is formed to be smaller in diameter than the cylinder liner 3 so that an annular gap 15 is formed between the outer circumferential surface of the piston 6 there are plural annular grooves 16 of differing depth arranged in parallel with one another, so that the annular gap 15 is formed into a labyrinth path. As a result, a rearward leakage of compressed air produced in the pump chamber 7 is decreased by the labyrinth path and supports the piston 6 with respect to the surroundings thereof to keep the piston 6 stable. In the illustrated example, the annular grooves 16 are so made that the front groove is comparatively deep and the two rear grooves are comparatively shallow.

In the above described embodiment, air from the gap 15 is utilized to cool the electric motor 4. Specifically, in the embodiment shown in FIG. 1, an air discharge opening 17 in a side wall of the pump casing 1 communicates with the external air through an inlet opening 18 in one end portion of a motor casing **4*a* surrounding the motor 4 and an outlet opening 19 in the other end portion of the motor casing 4*a* so that the leaked air from the gap 15 is introduced through the interior of the pump casing 1 into the motor casing 4*a* and the interior of the motor 4 is air-cooled. The motor 4 includes a rotor 4*b* at its central portion and a stator 4*c*** on its peripheral portion.

Figure 3:
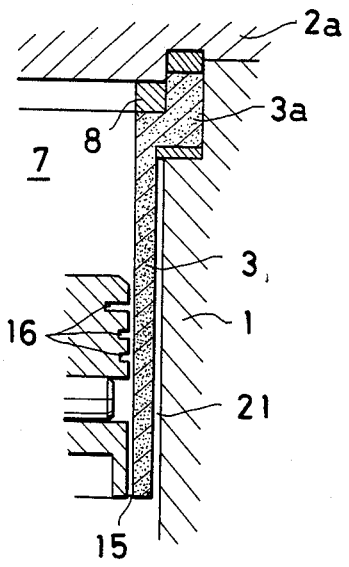
FIG. 3 is an enlarged sectional view of an important portion of an alternate embodiment of the present invention.

In this type of apparatus, the cylinder 2 tends to rise in temperature as a result of the compression heat of the air in the pump chamber 7, and for preventing such a rise in temperature the cylinder 2 is provided with cooling fins 20 on the outer surface of the peripheral wall thereof. This is, however, not as effective as may be desired. In view of this, in the embodiment shown in FIG. 3, the cylinder liner 3 is made of a sintered, permeable alloy and an annular gap 21 is formed between the outer circumferential surface thereof and the cylinder 2. The gap 21 is brought into communication with the external air through the interior of the pump casing 1 and the air discharge opening 17. In this case, the air discharge opening 17 may be of the type which is directly in communication with the external air (not shown) instead of the indirect communication through the interior of the motor casing 4*a* as in the previous embodiment.

With this construction, the air in the pump chamber 7 is leaked through the cylinder liner 3 to the interior of the gap 21 due to the air permeability of the liner 3. The air current which flows in the gap 21 is then discharged to the exterior through the interior of the pump casing 1 and the air discharge opening 17. In other words, this air current serves effectively to carry the internal heat to the exterior for effectively cooling of the cylinder 2.

During this operation, at the time of rearward movement of the piston 6, the air in the pump casing 1 is pushed by the piston 6, so that discharge thereof from the air discharge opening 17 is accelerated.

The foregoing sintered alloy is also rich in lubricating properties, and one example of the composition thereof is as described below, and the density thereof is, for instance, 6.0–6.6 g/cm$^3$.

Cu 2–6%, C 1.5–2.5%, Sn 0.1–1.0%, P 0.1–1.0% and Fe remainder.

Furthermore, the liner 3 is mounted in the cylinder 2 and is supported by the cylinder 2 at a larger diameter head portion 3*a*, with the annular gap 21 being formed below the head portion 3*a*.

Figure 4:
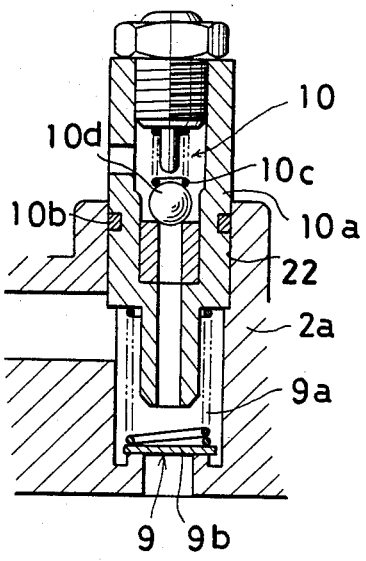
FIG. 4 is an enlarged sectional view of a valve section thereof.

It has been usual hitherto that an outlet valve and a safety valve are provided in the front portion of the cylinder separately from one another. As a result, this conventional type arrangement is defective in that the same requires a large space and is difficult to assemble. In view of this, in the preferred embodiments according to this invention, as shown clearly in FIG. 4, the safety valve 10 and the outlet valve 9 are disposed in the front and rear relationship and are arranged in an axial line so that the two valves 9 and 10 may be provided easily on the front portion of the cylinder 2 without requiring a large space. Additionally, a valve spring 9*a* which is positioned in front of the outlet valve 9 and serves to urge the valve 9 towards its closing side, is supported from the front by a valve housing 10*a* of the safety valve 10, so that the use of another spring receiving member can be omitted and the construction can be simplified and the assembling is made easier.

More in detail, the exhaust valve 9 and the safety valve 10 are provided in a cylinder head 2*a* which is the front portion of the cylinder 2. A guide opening 22 extending in a front and rear direction is made in the cylinder head 2*a*, and a valve spring 9*a* and a plate-shaped valve body 9*b* are placed therein to form the outlet valve 9. The valve housing 10*a* of the safety valve 10 is mounted in the guide opening 22 from the front with an O ring 10*b* mounted on the periphery of the valve housing 10*a* such that the resilient force of the valve spring 9*a* can be adjusted by the insertion depth of the valve housing 10*a*.

Thus, according to the present invention, there is provided around the outer circumferential surface of a piston an annular gap formed between the piston and a cylinder liner, and plural annular grooves are formed in the outer circumferential surface of the piston, so that the annular gap is formed into a labyrinth path. Consequently the piston is not brought into contact with the liner and use of lubrication oil such as grease or the like can be eliminated. The labyrinth path acts advantageously to decrease leakage of the compressed air generated in front of the piston, and additionally the air current flowing through the passage serves to support the piston away from the surroundings thereof to stabilize the operation of the piston.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. An air pump apparatus having a cylinder means extending from a pump casing, said cylinder means comprising a cylinder liner positioned within the walls of the cylinder means and having a front portion, a piston having a front and being mounted for reciprocating movement within said cylinder liner, a pump chamber being formed between the front of the piston and the front portion of the cylinder liner, an annular gap formed between said piston and an inner wall of said cylinder liner; said piston having a plurality of annular grooves formed on an outer circumferencial surface thereof, the annular gap and annular grooves forming a labyrinth path extending from said pump chamber; to the interior of the pump casing and said pump casing being provided with an air discharge opening for discharging air in the casing to the exterior.

2. An air pump apparatus as set forth in claim 1 wherein at least two of said plurality of annular grooves have different depths.

3. An air pump apparatus as set forth in claim 1 including motor means coupled to said piston means for reciprocatingly driving said piston means, said motor means having a housing for housing said motor means, said housing having an inlet opening and a first outlet opening; and said air discharge opening is in communication with said inlet opening in said housing, wherein air flows from said pump chamber, through said labyrinth path, said air discharge opening, and said inlet opening, past said motor means thereby cooling said motor means and through said first outlet opening.

4. An air pump apparatus as set forth in any one of claims 2, 3 or 1 wherein said cylinder liner is a permeable sintered alloy and wherein an annular gap is formed between an outer peripheral surface of said cylinder liner and an inner surface of said cylinder means.

5. An air pump apparatus as set forth in claim 4, wherein said permeable sintered alloy consists essentially of 2–6% copper, 1.5–2.5% carbon, 0.1–1.0% tin, and 0.1–1.0% phosphorous, and the remainder is iron.

6. An air pump apparatus as set forth in any one of claims, 2, 3, or 1, further including valve means mounted in a front portion of said cylinder means, said valve means including an axially aligned outlet valve and safety valve, and a spring means, said spring means pushing outlet valve towards its closed position and being supported by said safety valve.

* * * * *